US006471495B1

(12) United States Patent
Allen et al.

(10) Patent No.: US 6,471,495 B1
(45) **Date of Patent: *Oct. 29, 2002**

(54) MINIATURE WELL AND IRRIGATION PUMP APPARATUS

(75) Inventors: Peter B. Allen, Slidell; Delmer Cotton Renner, Winnsboro, both of LA (US)

(73) Assignee: Lockheed Martin Corporation, New Orleans, LA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/699,755

(22) Filed: Oct. 30, 2000

Related U.S. Application Data

(63) Continuation-in-part of application No. 09/007,843, filed on Jan. 15, 1998, now abandoned.

(51) Int. Cl.[7] ..... F04B 17/00

(52) U.S. Cl. ..... 417/423.6; 417/424.1; 417/423.15; 417/423.12; 417/423.13

(58) Field of Search ..... 417/423.6, 423.15, 417/423.12, 424.1; 416/170 R; 415/111, 124.2

(56) References Cited

U.S. PATENT DOCUMENTS

| | | | | |
|---|---|---|---|---|
| 1,170,512 A | | 2/1916 | Chapman | 417/423.12 |
| 1,745,547 A | | 2/1930 | Layne | |
| 2,643,615 A | | 6/1953 | Murphy et al. | 417/423.12 |
| 2,764,943 A | | 10/1956 | Peters | 417/423.1 |
| 3,059,849 A | | 10/1962 | Saltzman | |
| 3,163,117 A | | 12/1964 | Haentjens | |
| 3,746,473 A | | 7/1973 | DeLancey et al. | |
| 3,782,860 A | | 1/1974 | DeLancey et al. | |
| 3,785,752 A | | 1/1974 | Crespo | 417/319 |
| 3,799,690 A | | 3/1974 | Klaas | |
| 4,073,606 A | | 2/1978 | Eller | 417/124.2 |
| 4,082,482 A | | 4/1978 | Erickson et al. | |
| 4,875,827 A | | 10/1989 | Gschwender et al. | |
| 5,803,169 A | | 9/1998 | Bassinger et al. | |
| 6,050,788 A | * | 4/2000 | McEwen et al. | 417/423.11 |

FOREIGN PATENT DOCUMENTS

| | | | |
|---|---|---|---|
| DE | 500204 | 6/1930 | 417/423.6 |
| DE | 2651-224 | 5/1978 | 417/423.1 |

* cited by examiner

*Primary Examiner*—Cheryl J. Tyler
(74) *Attorney, Agent, or Firm*—Garvey, Smith, Hehrbass & Doody, L.L.C.; Charles C. Garvey, Jr.; Seth M. Nehrbass

(57) ABSTRACT

An irrigation pump for use in irrigating small fields or supplementing larger irrigation systems can also be used for portable water supply for emergency, military, or for under-developed countries. The pump system is designed to be light-weight and semi-portable and can be powered with a small engine or electric motor. The apparatus uses a down well impeller that is driven by a flexible vertical shaft and a vertical shaft motor drive or engine. The pump impeller incorporates its own thrust and journal bearings for the pump shaft. The bearings are water lubricated. The main drive shaft is flexible and elongated and is supported over its entire length with a flexible shaft guide sleeve. The flexible drive shaft is surrounded by a convoluted well pipe so that the drive shaft and the well pipe can be removed from the well casing bore as a unit and then coiled for storage. A flange on the outlet fitting can be used to bolt the entire assembly of engine and outlet fitting to the well head at a well casing flange. That entire assembly of outlet fitting, engine (or motor), well pipe, drive shaft and impeller can be removed as a unit from the well casing by simply unbolting the outlet fitting from the casing.

13 Claims, 12 Drawing Sheets

MINIATURE WELL AND IRRIGATION PUMP APPARATUS

CROSS-REFERENCE TO RELATED APPLICATIONS

This is a continuation-in-part of U.S. patent application Ser. No. 09/007,843 (filed Jan. 15 1998) now abandoned, which application is hereby incorporated by reference and priority of which application is hereby claimed.

BACKGROUND OF THE INVENTION

1. Field of the Invention

The present invention relates to miniature well pumps and irrigation pumps, and more particularly to an improved miniature irrigation pump apparatus that includes a flexible drive shaft disposed within an elongated well pipe preferably flexible and convoluted that can be placed inside a well casing, wherein the lower end portion of the well pipe carries an axial flow inducer type impeller and the upper end portion of the well pipe communicates with an outlet fitting that enables pumped water to be discharged for irrigation or the like. The outlet fitting includes a mount for a motor/engine drive and wherein a rotary type seal seals the penetration of the flexible drive shaft through the outlet fitting. The pump impeller shaft is supported by wetted bearings to form rotary supports in between the impeller and pump shroud. The pump shroud is loosely supported by the well pipe.

2. General Background of the Invention

Small pumps are often needed for producing a potable water supply for emergency, military or like uses or for use in underdeveloped countries. Such pumps are also needed for irrigation purposes, many times irrigating small fields or to supplement larger irrigation systems. Such pump systems must be cost effective, light weight, and in many cases portable. Power requirements often dictate that only very small engines or motors are available.

A minimum flow requirement for a small pump that would be used to irrigate small acreage lots, for example, would be about one hundred to two hundred (100–200) gallons per minute from a 6–8 inch well (casing diameter) within an approximate water table of about fifteen (15) feet and a draw down to twenty one (21) feet. A yearly average usage as a supplemental pump system would be about 100 hours, for example.

Current small irrigation pumping systems consist of various types. Typical integrated pump and engine systems are compact but are often limited to about twenty (20) feet and the efficiency is about 50% at 12 feet. The "down well" pumps have much higher efficiencies and will pump from lower levels. These may be shaft driven by an internal combustion engine with a ninety (90) degree gear drive or by an electric motor or a down well sealed electric motor. However, electric motors are disadvantageous because they require power cables to be run out into the field or require an engine driven generator.

Various patents have issued for well pumps and irrigation pumps. One example is the Crespo pump disclosed in U.S. Pat. No. 3,785,752 entitled "Portable Submersible Pump". The '752 patent discloses a submersible pump wherein the motor unit is removed from the liquid environment and the motive force for the pump impeller, located in the liquid to be pumped, is transmitted from the motor unit by means of a flexible power shaft. The pump is portable and may have a gear box or a clutch. In addition, the submersible pump may take the form of an axial flow pump when low to moderate lifts are required at large capacities. A spacial flexible shaft terminal is provided wherein the pump and impeller are attached directly to the flexible shaft unit.

A sumpless pump is disclosed in the DeLancey et al. U.S. Pat. No. 3,782,860. The '860 patent discloses a pump assembly adapted to be installed as a complete assembly in a conventional pipe riser with the pump assembly being so dimensioned that all its parts may be inserted in the upper end opening of a conventional riser of about four (4) inch diameter.

The Gschwender et al. U.S. Pat. No. 4,875,827 discloses a fluid pump that has a casing and a support tube mounted within the casing. A rotatably mounted drive shaft is inserted through the support tube and has a propeller mounted on one end thereof for moving fluid through the pump. A helical shaped bearing is seated between the drive shaft and the support tube for supporting the shaft and permitting fluid flow therethrough.

U.S. Pat. No. 3,799,690, issued to Emil B. Klaas, discloses a pumping apparatus particularly suitable for efficiently pumping relatively large volumes of fluid such as water from one elevation to another including a propeller type blade mounted for rotation adjacent to the immersed open inlet end of a flow conduit of pipe, rotation of said blade establishing a head of water in the conduit, filling the conduit upstream thereof and forcing the fluid to flow through the conduit to be exhausted therefrom usually at a higher elevation. The subject pump is stated to be suited to be operated in tandem with other similar pumping means in the same conduit in situations where it is desired to move the fluid to a considerably higher elevation.

A centrifugal pump with center intake is disclosed in U.S. Pat. No. 2,643,615, issued to R. J. Murphy et al.

The DeLancey et al U.S. Pat. No. 3,7426,473 discloses a pump assembly adapted to be installed as a complete assembly in a conventional or about four (4) inch pump riser as part of a system with the pump assembly being so dimensioned that all of its parts may be inserted in the upper end opening of the conventional riser of about four inch diameter.

An articulate turbine pump is the subject of U.S. Pat. No. 4,082,482.

The Haentjens U.S. Pat. No. 3,163,117 discloses a variable speed cantilevered shaft pump.

The Saltzman U.S. Pat. No. 3,059,849 discloses a water meter accessory that includes an accessory drive flex cable.

The present invention provides an improvement to existing prior art type pumping systems primarily useful in irrigating small fields or supplementing larger systems such as at the corners of large rotary systems.

BRIEF SUMMARY OF THE INVENTION

The pump apparatus of the present invention was designed to pump irrigation water and/or potable water. Therefore, it could be used in an emergency, for military or like use or in underdeveloped countries.

The pumping system of the present invention can be fitted into a small space such as for example a box measuring only a few feet in each dimension or the back of a pick-up truck.

The outlet fitting and flexible well pipe with pump attached could be packaged around an engine, the engine being bolted to a base plate on the outlet fitting. The engine oil (and spares such as air and oil filters) could then be included, the package being installed in less than one hour by placement into an existing well bore.

The present invention thus provides an improved well pump apparatus adapted to be placed in an existing well. The pump apparatus of the present invention includes a well casing that extends under the earth's surface and includes a bore containing a fluid to be pumped, the well casing having an upper end portion with a flange defining well-head.

A flexible well pipe member extends from the well head down into the well bore to communicate with the fluid to be pumped. The well pipe member includes an upper end portion, a lower end portion, and a flow bore for conveying fluid that is to be pumped between the lower end and the upper end.

An outlet fitting is positioned at the well head, the outlet fitting having a wall portion surrounding a flow bore that enables fluid to be discharged laterally out of the top of the well at the wellhead. An impeller is positioned at the lower end of the flexible well pipe, the impeller being rotatable during pumping for effecting a transmittal of fluid from the lower end portion of the well pipe member to the upper end portion thereof and into the outlet fitting bore for discharge.

In a preferred embodiment, the drive portion includes a motor drive for rotating the flexible drive shaft and a water seal in between the motor drive and flexible drive shaft.

A flexible drive shaft is provided for rotating the impeller, the flexible drive shaft extending in between the impeller and the outlet fitting and including a drive portion, a rotary shaft seal that extends through the wall of the outlet fitting at the well head for communication with a motor drive, engine, or the like. A wetted bearing forms a rotary support in between the impeller and the well pipe, but can be open at both ends to facilitate water lubrication.

The flexible drive shaft is preferably supported at its lower end portion by attachment to the impeller shaft with at least one journal bearing and at least one thrust bearing. The flexible drive shaft is preferably retained and supported by the drive portion of the motor/engine drive.

In a preferred embodiment, the impeller's rigid drive shaft and the elongated flexible drive shaft are each supported with water lubricated bearings. The impeller is preferably an axial flow inducer type impeller or a mixed axial centrifugal type.

Preferably, a shroud at the lower end portion of the well pipe supports and surrounds the impeller. Preferably, the flexible drive shaft is covered along the majority of its length with a flexible sleeve that protects the well pipe from abrasion. The sleeve is open ended at either of its ends to allow water lubrication and cooling of the drive shaft and rotary shaft seal.

Preferably, a water face seal is provided at the well head that includes a rotating member for sealing water away from the drive portion.

Placement of the flexible drive shaft inside the well pipe provides many advantages which include, but are not limited to increasing ease of handling when placing and removing the unit from a well and during transportation; allowing the flexible shaft to take tensile loads placed on the well pipe; allowing the well pipe to serve as a barrier to the flexible shaft from the external elements; and minimizing overall size of the unit for placement in a well.

While certain novel features of this invention shown and described below are pointed out in the annexed claims, the invention is not intended to be limited to the details specified, since a person of ordinary skill in the relevant art will understand that various omissions, modifications, substitutions and changes in the forms and details of the apparatus of the present invention illustrated and in its operation may be made without departing in any way from the spirit of the present invention. No feature of the invention is critical or essential unless it is so expressly stated as being "critical" or "essential."

BRIEF DESCRIPTION OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION OF THE INVENTION

Figure 1:
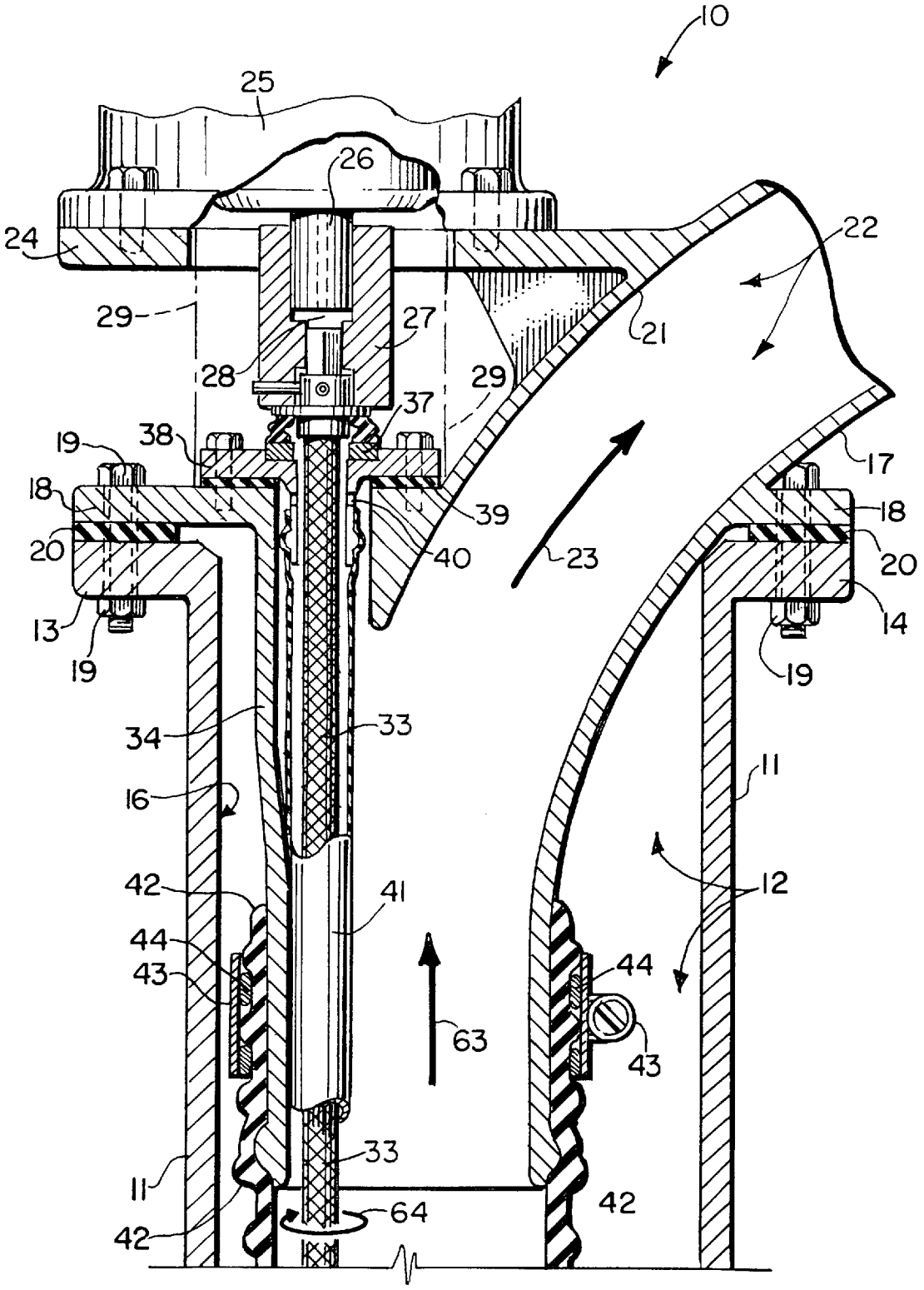
FIGS. 1, 1A and 1B are fragmentary sectional elevational views of an alternate embodiment of the apparatus of the present invention showing the upper end portion thereof.
Figure 1A:
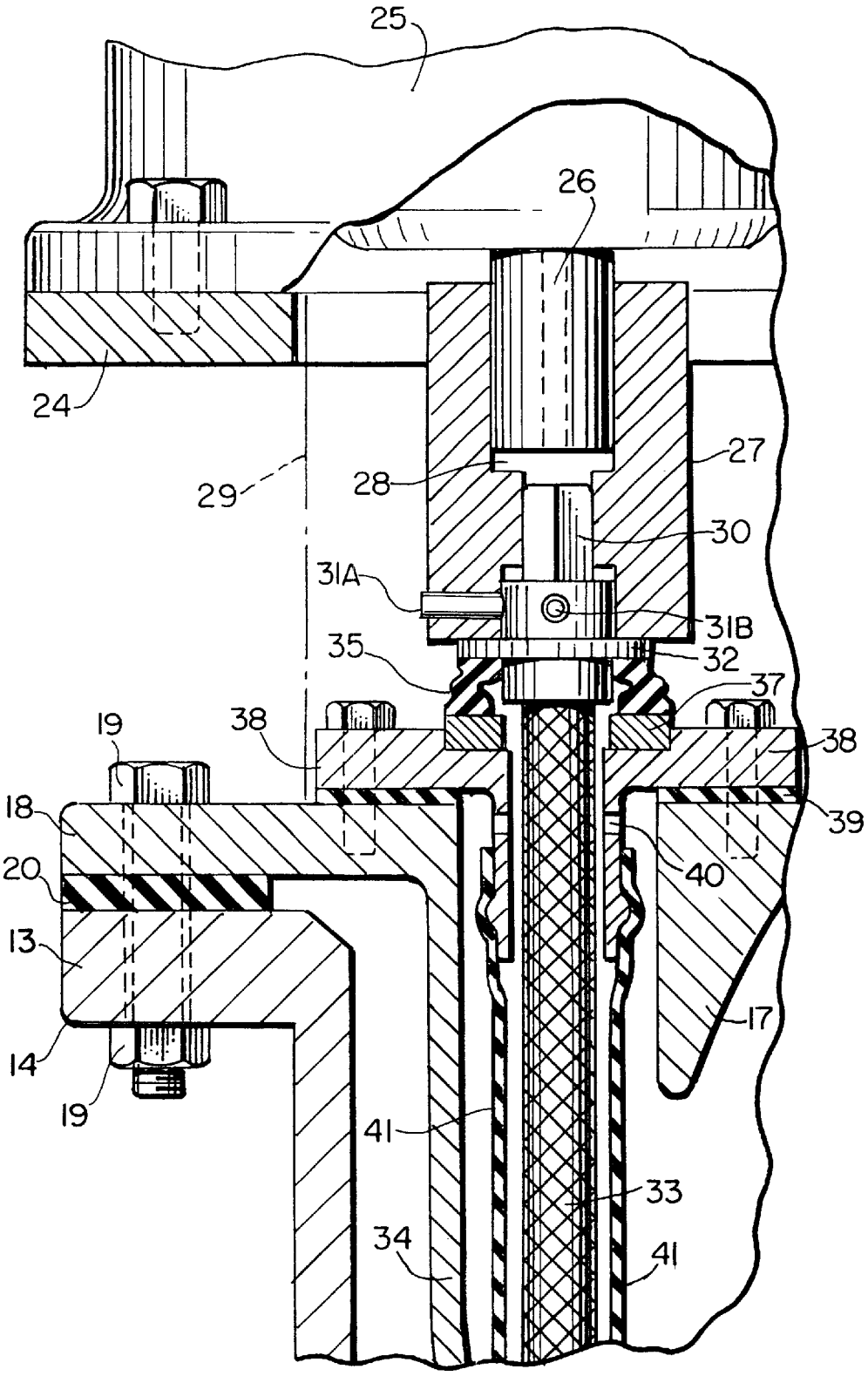
Figure 1B:
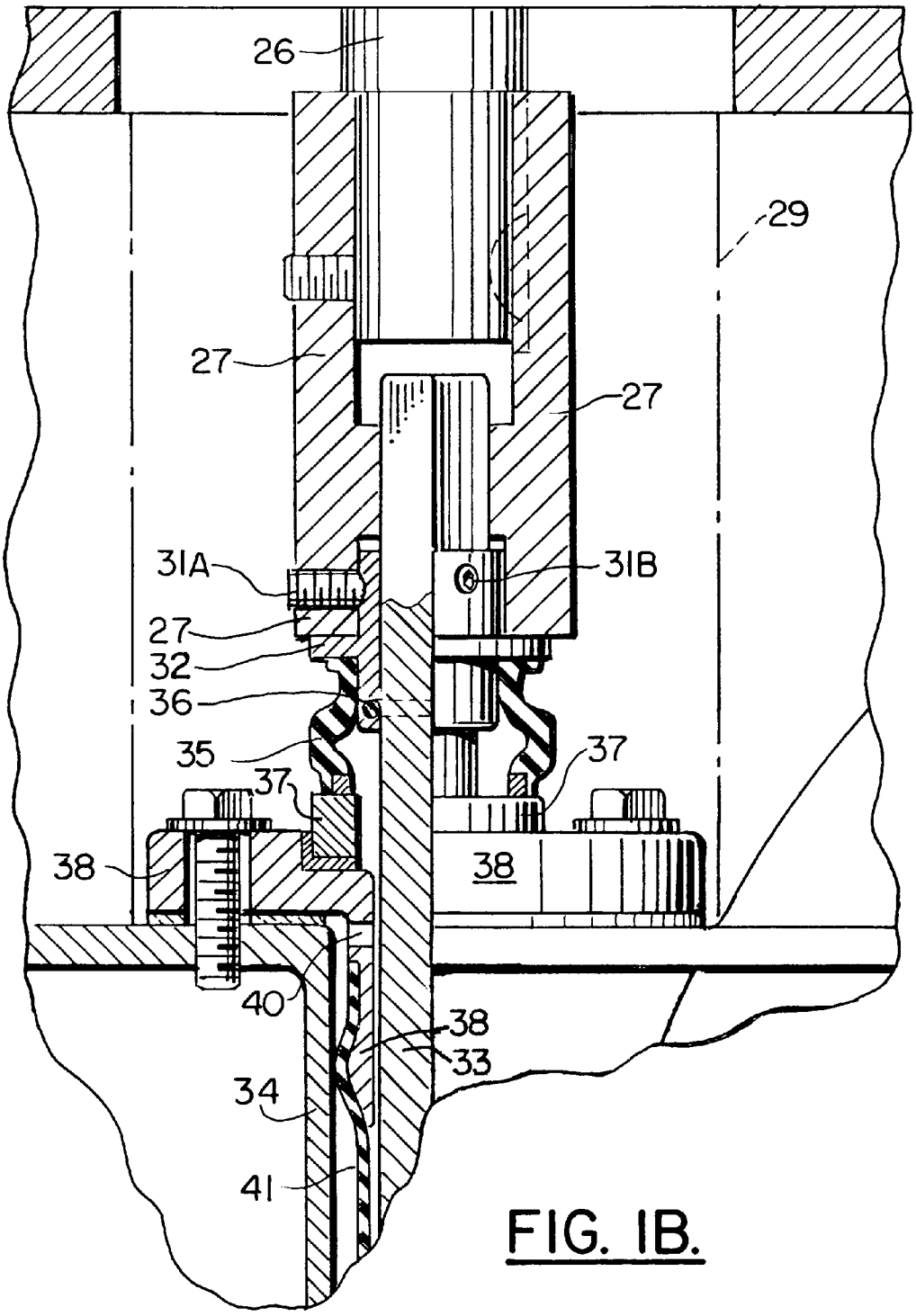
Figure 2:
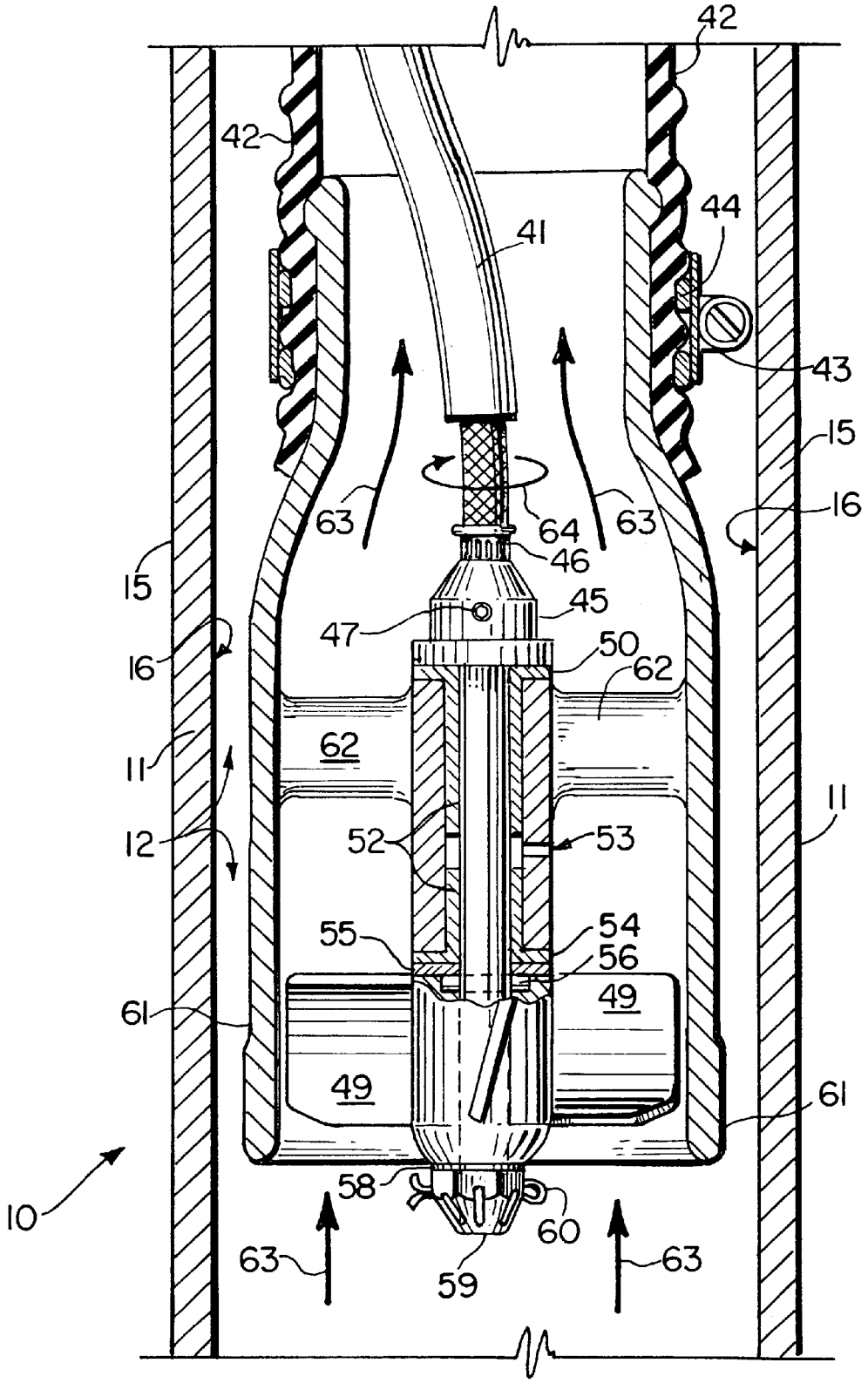
FIGS. 2–2A are fragmentary sectional elevational views of an alternate embodiment of the apparatus of the present invention showing the lower end portion thereof.
Figure 3:
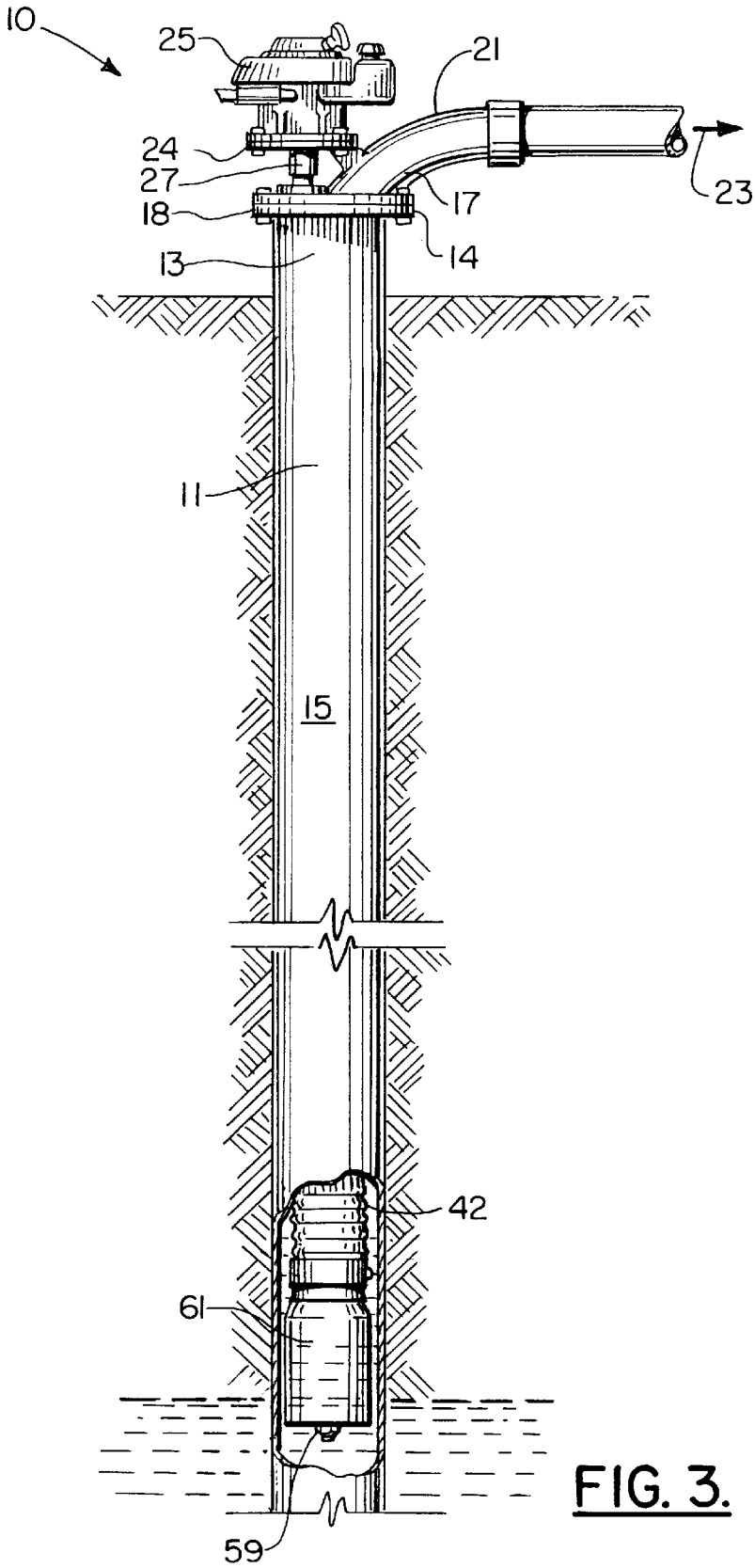
FIG. 3 is an elevational view of a preferred embodiment of the apparatus of the present invention.
Figure 9:
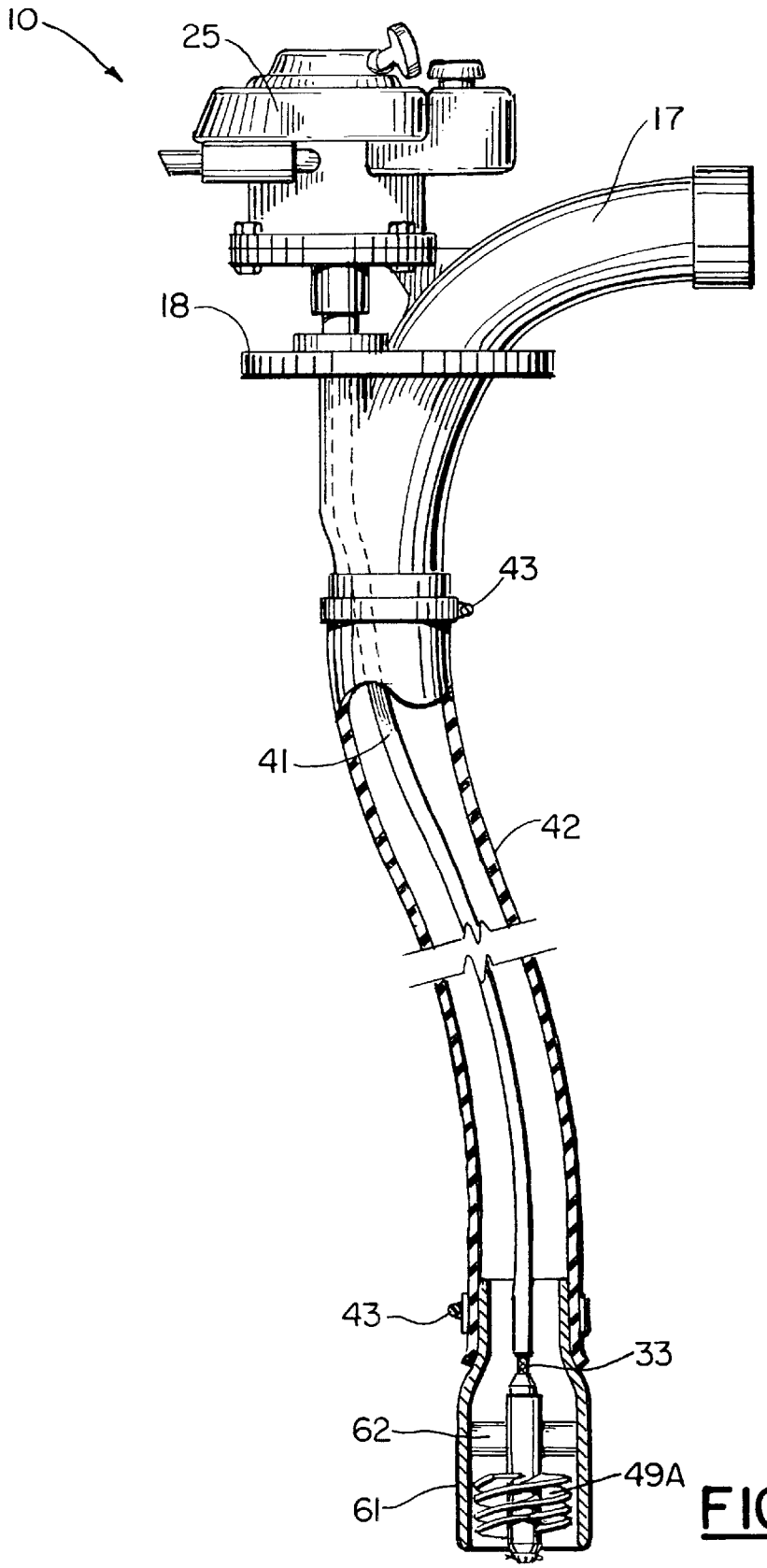
FIG. 9 is an overall schematic view of a preferred embodiment of the apparatus of the present invention showing flexing.

FIGS. 1–3 show generally a preferred embodiment of the apparatus of the present invention designated generally by the numeral 10. FIG. 9 is an overall schematic view of a preferred embodiment of the apparatus of the present invention. Motor/engine 25 is operatively connected to flexible drive shaft 33 which itself is operatively connected to impeller 49. Impeller 49 is at least partially encased by shroud 61. Shroud 61 is attached to well pipe 42 through clamp 43 which itself partially encases flexible drive shaft 33. Well pipe 43 is attached to outlet fitting 17.

Figure 10:
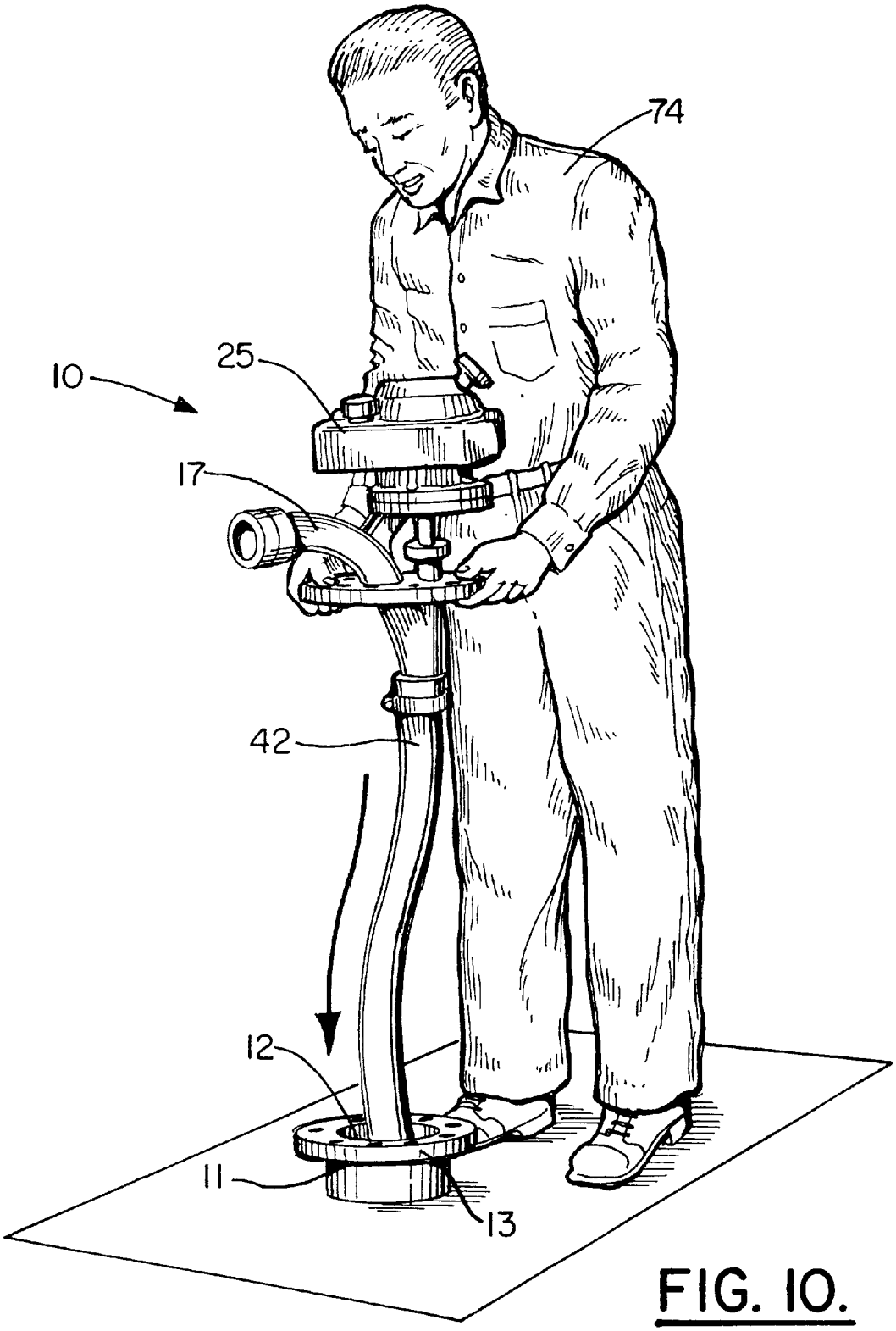
FIG. 10 shows the invention being placed in a well.

FIG. 10 shows the apparatus of the present invention being placed in a well. Man 74 first places shroud 61 of well pump apparatus 10 into well bore 12 of well casing 11. Outlet fitting 17 is then attached to wellhead 13 before pumping operations are begun.

Figure 4:
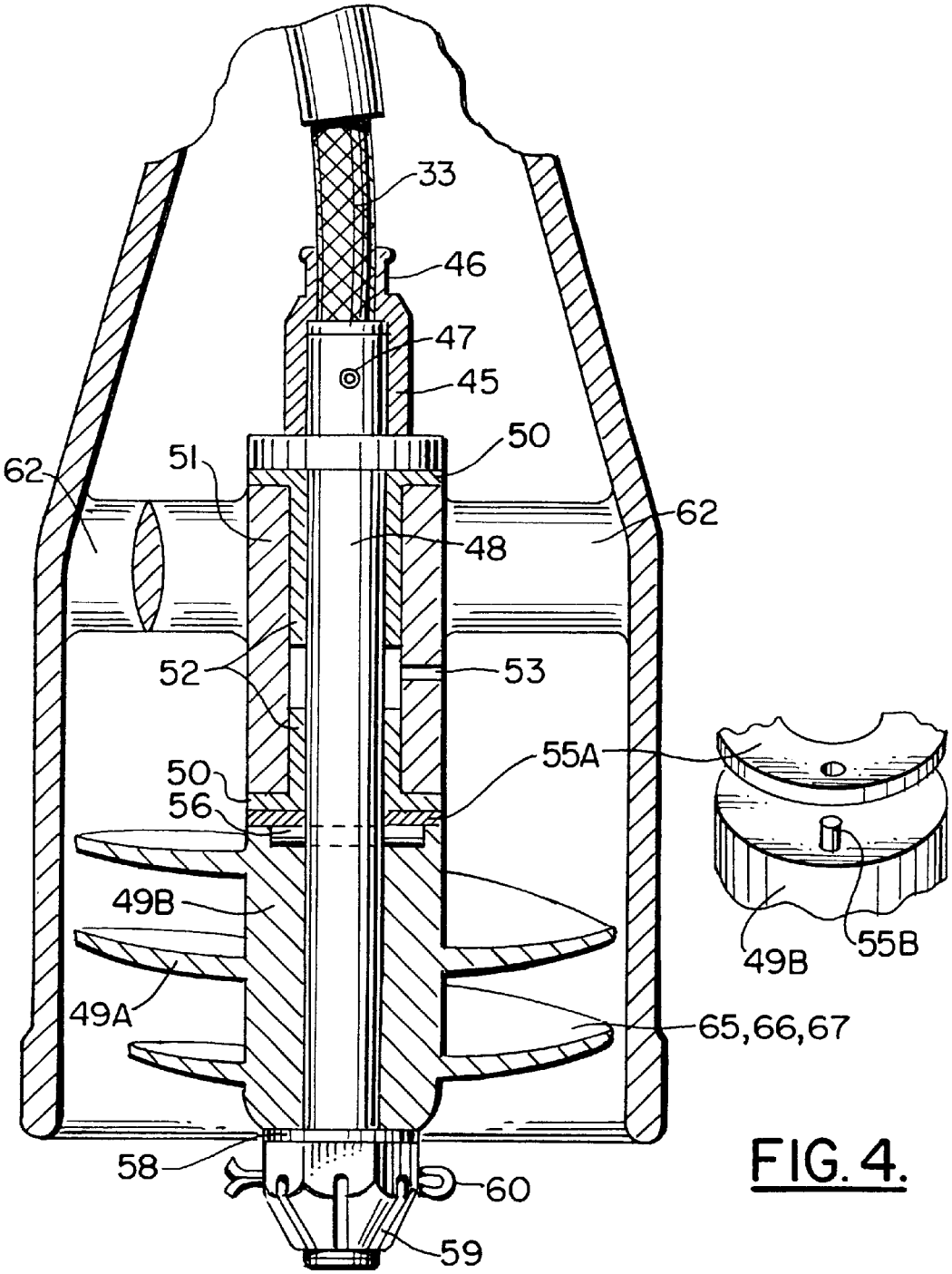
FIGS. 4–4A are sectional elevatroval views of a screw-type impeller arrangement for use with the apparatus of the present invention.
Figure 4A:
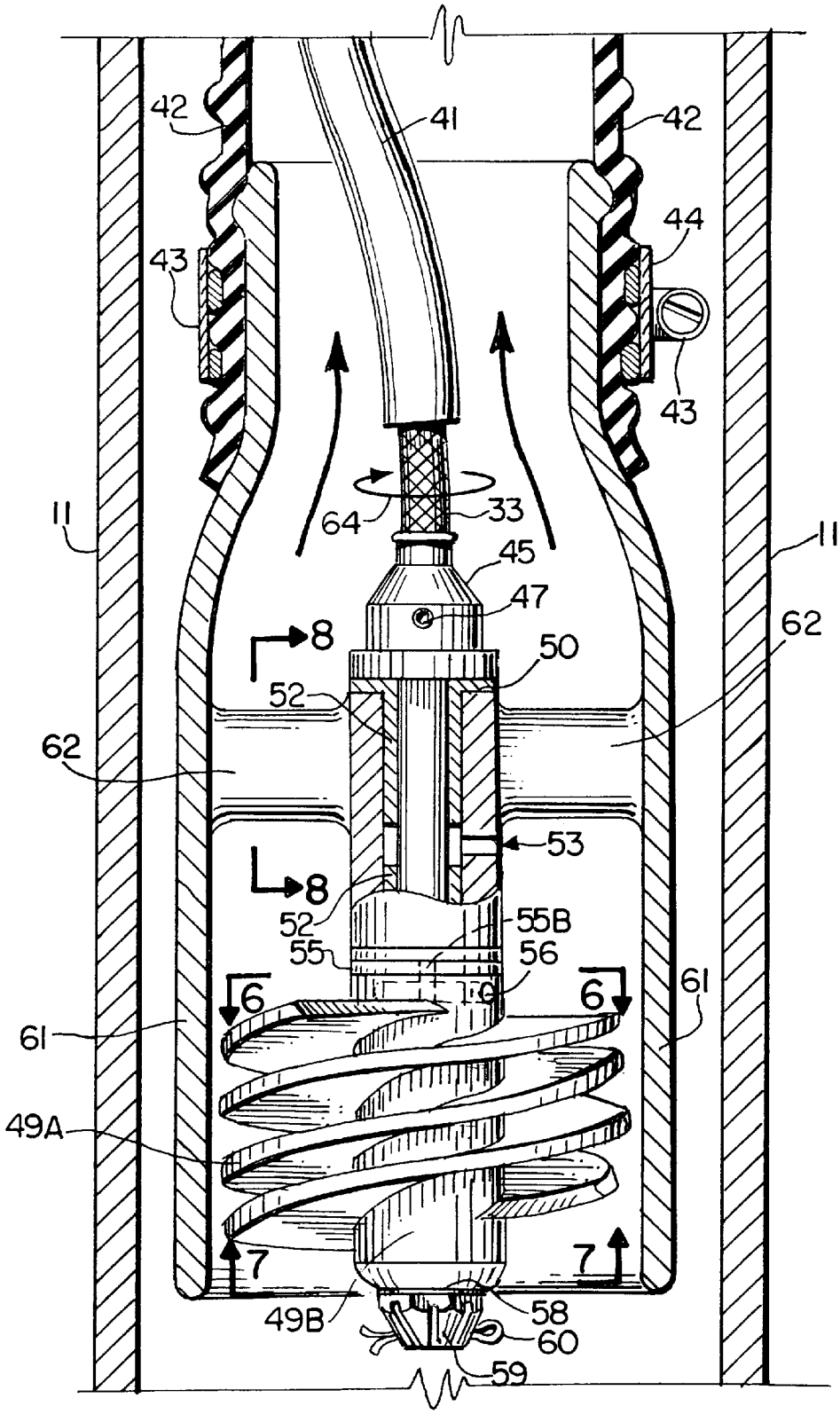

Well pump apparatus 10 includes an outlet fitting 17 that can be mounted on well casing 11 at flange 14 on well head 13. Well casing 11 includes a well bore 12 into which is disposed the lower end of the outlet fitting 17 and an elongated length of well pipe 42 that supports a shroud 61 and an impeller 49 (or 49A —FIG. 4) as will be described more fully hereinafter. The well pipe 42 is preferably flexible and convoluted, but it can be rigid (where coiling is not desired).

Figure 11:
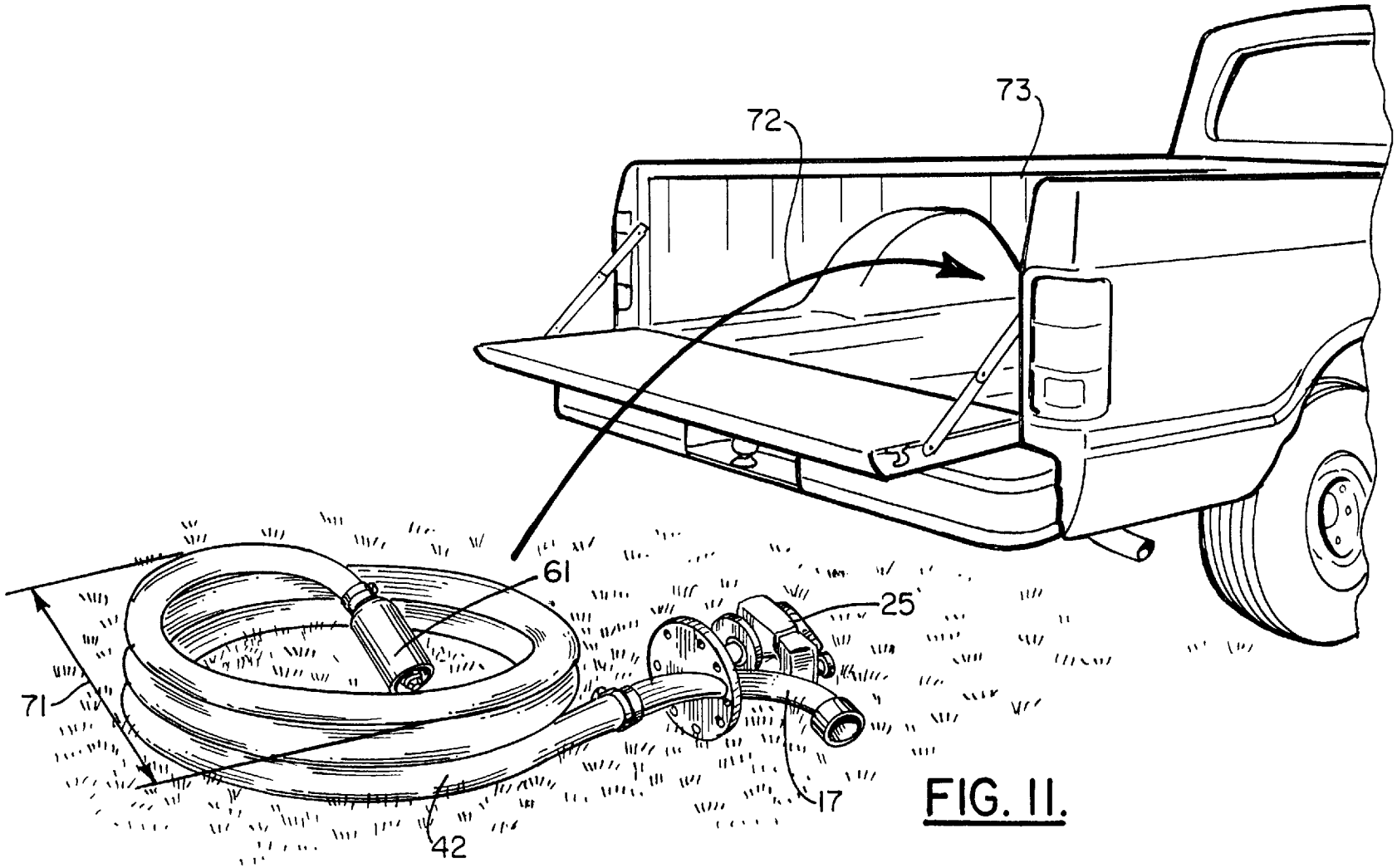
FIG. 11 shows the invention coiled for storage, for example in the back of a small pickup truck.

The present invention provides a light weight, easily transportable well pump apparatus 10 that can be stored in a very small space such as, for example, in the back of a small pickup truck as shown in FIG. 11. The well pipe 42, flexible drive shaft 33 and its sleeve 41 can be coiled after removal from the well casing 11 and/or during transport. The minimum diameter of the coil is dependent upon the flexibility of flexible drive shaft 33. This minimum diameter shown by dimensional line 71 can vary between one to ten feet (1'–10'). The coiled well pump apparatus 10 can be placed in a pickup truck 73 as shown by arrow 72.

The flexible drive shaft 33 is commercially available and can be obtained from manufacturers such as S S White, 151 Old Brunswick Road, Piscataway, N.J. 08854; Elliot, P.O.Box 773, Binghamptom, N.Y. 13901 (telephone number (607)772-0404); and Suhner, P.O.Box 1234, Rome, Ga. 30162 (telephone number (706)235-8047). It is preferably ⅝ inch nominal diameter.

Well casing 11 provides an annular flange 14 at well head 13. The flange 14 communicates with a cylindrically-shaped casing wall 15 having an inside surface 16. This inside surface 16 surrounds water to be pumped. The water to be pumped has a water surface below the well head 13. The well pipe 42 and an impeller 49 or 49A are extended to below this well water surface during use.

Outlet fitting 17 includes an annular mounting flange 18 that makes with and can be bolted to annular flange 14 of well casing 11. Mounting flange 18 can be affixed to casing flange 14 using a plurality of bolted connections 19. Gasket 20 can be placed in between casing flange 14 and mounting flange 18. This enables the apparatus 10 of the present invention to be quickly installed and quickly removed for transport, repair, maintenance and the like.

Outlet fitting 17 includes elbow section 21 having a curved bore 22 that channels discharging water laterally from the well in the direction of arrow 23. During use, the water is pumped with impeller 49, preferably an axial flow inducer type impeller that is driven by flexible drive shaft 33 rotated by a drive 25 (e.g., an internal combustion engine or electric motor drive). The motor drive 25 is attached to engine/motor mounting flange 24. Flange 24 can be integrally cast with elbow section 21 of outlet fitting 17 as shown in FIG. 1. The drive 25 can be a small internal combustion engine (for example, 5–12 h.p.) or an electric motor. The engine/motor drive 25 provides a vertical motor shaft 26 with a spline or key connection so that the shaft 26 drives coupling 27 when the drive 25 is operating.

Coupling 27 provides a socket 28 that is correspondingly shaped and sized to receive vertical shaft 26 of motor/engine 25 and to form a connection therewith. Guard 29 covers the connection between shaft 26 and flexible drive shaft 33. Coupling 27 has a square drive 30 that is sized to receive the square end of the flexible shaft 33. The coupling 27 also provides a socket that connects to retainer 32 with set screws 31A. The retainer 32 has a square bore section that slides over the flexible shaft 33 and is rotated 45°, and then held from rotating by two set screws 31B. This retains the shaft to retainer 32, and retainer 32 to coupling 27. Water seal 35 is a rotating element that works in combination with retainer 32 and O-ring seal 36 between the retainer 32 and flexible shaft 33 and fixed water seal element 37 to prevent water from traveling from guide tube 34 to engine/motor drive 25.

Guide tube 34 extends through the wall of elbow section 21 as shown in FIG. 1. The guide tube 34 is thus a generally cylindrically-shaped tube that enables the drive shaft 33 to extend vertically along an axial line that is generally parallel with the central longitudinal axis of well pipe 42 so that it can form a connection with the motor drive 25. The discharged water and shaft 42 both travel along a vertical path until elbow section 21 changes the direction of fluid flow from generally vertical to generally horizontal or lateral. Elbow section 21 thus channels fluid laterally as shown by the arrow 23 in FIG. 1. At the elbow section 21, the drive shaft 33 continues its vertical path upwardly through guide tube 34 to meet its connection with motor drive 25. Thus, drive shaft 33 and engine drive 26 have a common, generally vertical longitudinal axial.

Fixed water seal element 37 is nested in a correspondingly-shaped recess of adapter flange 38 which can be affixed with bolted connections to flange 18 of outlet fitting 17. Gasket 39 can be positioned in between adapter flange 38 and outlet fitting flange 18. Flexible shaft 33 can be covered along substantially its entire length with flexible shaft guide sleeve 41. This flexible sleeve 41 prevents abrasion of well pipe 42 by the metallic shaft 33. Flexible sleeve 41 is preferably constructed from high density polyethylene (HDPE). Vent 40 in the flexible sleeve 41 allows air to communicate with the space in between shaft 33 and guide tube 34.

Well pipe 42 is preferably an elongated convoluted pipe section 42 that is preferably flexible so that it can be coiled in loops for storage when not in use. A clamp 43 can be used to secure the upper end of well pipe 42 to elbow section 21 of outlet fitting 17 as shown in FIG. 1. Filler coil 44 can be used to perfect a connection between clamp 43 and well pipe 42 as shown in FIG. 1. Likewise, clamp 43 and filler coil 44 can be used to form an attachment between the lower end of well pipe 42 and shroud 61.

At the lower end portion of flexible drive shaft 33, a connection is formed with impeller 49 as shown in FIG. 2. Flexible shaft coupling 45 can be crimped at 46 to flexible shaft 33 and coupled to pump shaft 48 using drive pin 47 that passes through shaft 33. Pump shaft 48 carries impeller 49 and rotates with drive pin 47 and flexible shaft 33. The impeller 49 is preferably an axial flow inducer-type impeller mounted on thrust bearings 50, 54 and with journal bearings 52. Water lubrication hole 53 insures that the bearings 50, 54 and 52 are wetted.

Figure 6:
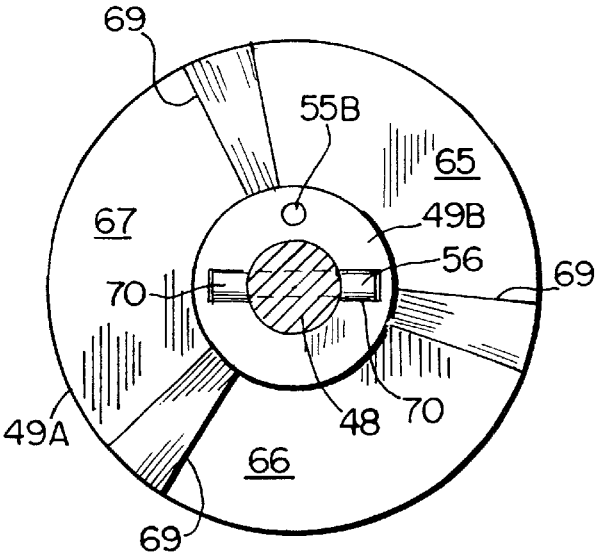
FIG. 6 is a fragmentary view of the impeller arrangement of FIGS. 4, 4A, and 5 looking at the trailing edge portion of the impeller.
Figure 7:
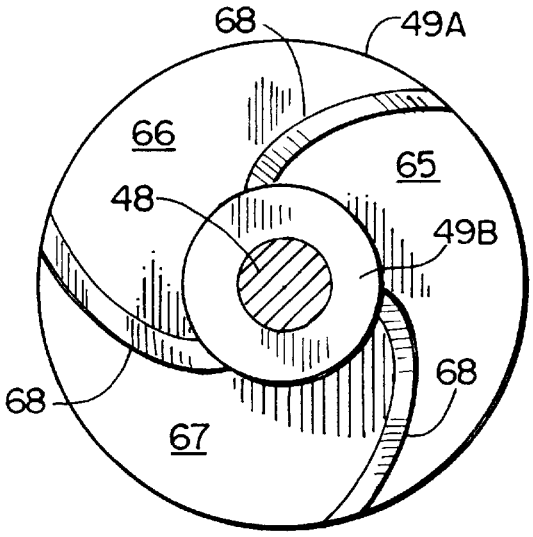
FIG. 7 is a fragmentary view of the impeller arrangement of FIGS. 4, 4A, and 5 looking at the leading edge portion of the impeller.
Figure 8:
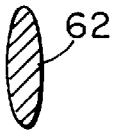
FIG. 8 is a sectional view taken along lines 8—8 of FIG. 4A.
Figure 5:
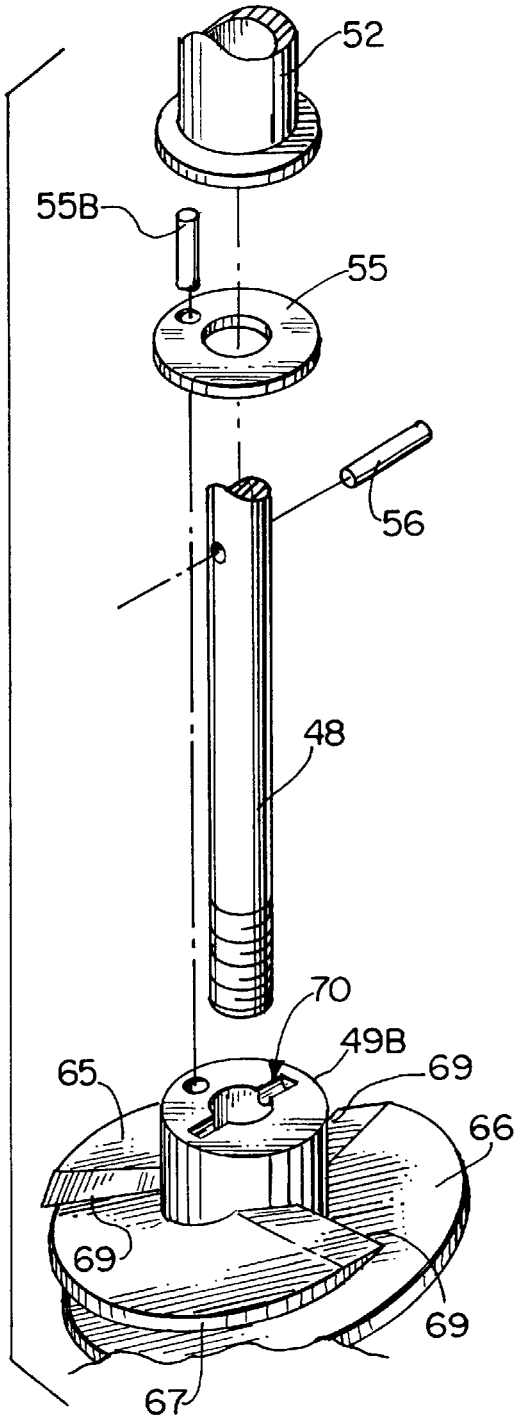
FIG. 5 is a partial perspective view of a preferred embodiment of the apparatus of the present invention illustrating a screw-type impeller arrangement of FIGS. 4–4A.

Thrust bearing 54 is provided with a bearing spacer 55 held in position with axial pin 55B that attaches axially and parallel to the impeller 49. The impeller 49 (or 49A) is driven by the drive pin 56 that passes loosely through the pump shaft 48. It can be easily removed for assembly and maintenance. Drive pin 56 is retained in the impeller 49 or 49A boss 49B by means of a closed slot 70 in the impeller 49 boss 49B (also see FIGS. 5–7). Impeller 49 can be held in position with castellated nut 59, split pin 60, and washer 58. They restrain the impeller 49 and hold it against drive pin 56. Shroud 61 is of an enlarged diameter to accommodate the size of impeller 49 as shown in FIG. 2. Support vanes 62 extend between shroud 61 and bearing boss 51. Arrows 63 indicate the vertical flow path for fluid in well pipe 42. Arrows 64 indicate the rotational direction of drive shaft 33.

Figure 2A:
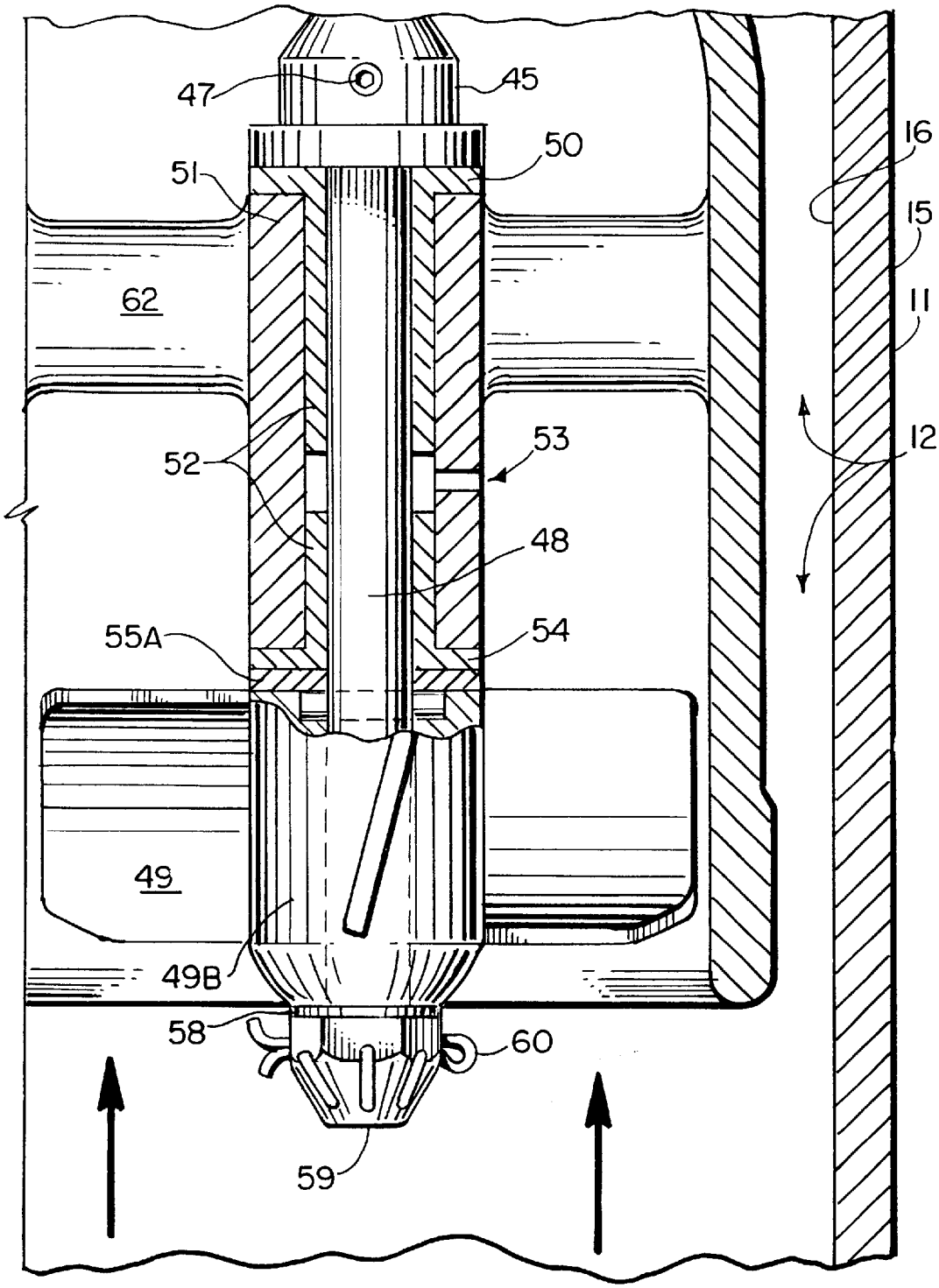

In FIGS. 4, 4A, and 5–8, impeller 49A is an axial flow inducer screw-type impeller that can be used with the apparatus 10 of the present invention as a preferred embodiment and in place of the propeller type impeller 49 shown in FIGS. 2–2A.

Impeller 49A has a boss 49B that carries three blades 65–67. Each blade has a leading edge and a trailing edge.

Each blade extends circumferentially about 360 degrees. The impeller 49A can be about 4½ inches in diameter and have a length of about 2 inches. The pitch can change slightly on each blade.

The following table lists the reference numerals and reference descriptions as used herein and in the drawings attached hereto.

PARTS LIST

| Reference Number | Description |
|---|---|
| 10 | well pump apparatus |
| 11 | well casing |
| 12 | well bore |
| 13 | wellhead |
| 14 | flange |
| 15 | casing wall |
| 16 | inside surface |
| 17 | outlet fitting |
| 18 | mounting flange |
| 19 | bolted connection |
| 20 | gasket |
| 21 | elbow section |
| 22 | bore |
| 23 | arrow |
| 24 | engine/motor mounting flange |
| 25 | engine/motor |
| 26 | engine/motor shaft |
| 27 | coupling |
| 28 | socket |
| 29 | guard |
| 30 | square drive |
| 31A | set screw |
| 31B | set screw |
| 32 | retainer |
| 33 | flexible drive shaft |
| 34 | guide tube |
| 35 | water seal |
| 36 | o-ring seal |
| 37 | water seal |
| 38 | adapter flange |
| 39 | gasket |
| 40 | vent |
| 41 | flexible sleeve |
| 42 | well pipe |
| 43 | clamp |
| 44 | filler coil |
| 45 | flexible shaft coupling |
| 46 | crimp |
| 47 | drive pin |
| 48 | pump shaft |
| 49 | impeller |
| 49A | inducer type impeller |
| 49B | boss |
| 50 | thrust bearing |
| 51 | bearing boss |
| 52 | journal bearing |
| 53 | water lubrication channel |
| 54 | thrust bearing |
| 55 | spacer |
| 55A | pin |
| 56 | drive pin |
| 57 | blade |
| 58 | washer |
| 59 | castallated nut |
| 60 | split pin |
| 61 | shroud |
| 62 | vane |
| 63 | arrow |
| 64 | arrow |
| 65 | blade |
| 66 | blade |
| 67 | blade |
| 68 | leading edge |
| 69 | trailing edge |
| 70 | slot |
| 71 | dimensional line |

-continued

PARTS LIST

| Reference Number | Description |
|---|---|
| 72 | arrow |
| 73 | pick-up truck |
| 74 | man |

The foregoing embodiments are presented by way of example only; the scope of the present invention is to be limited only by the following claims.

What is claimed is:

1. A pump apparatus for pumping fluid from a well comprising:

a) a flexible shaft with first and second ends;

b) a drive portion operatively connected to the first end of the flexible shaft and imparting rotational movement to the shaft;

c) a flexible well pipe member with first and second end portions, the well pipe member positioned over and encasing at least a portion of the flexible shaft, with the first end portion of the well pipe member being closest to the first end of the flexible shaft and the second end portion of the well pipe member being closest to the second end of the flexible shaft;

d) the well pipe member and flexible shaft forming an assembly that is capable of being coiled into a circle with a minimum diameter between about one to ten feet (1'–10'), and further forming a space for transmitting fluid therethrough;

e) an outlet fitting flow bore connected to the first end portion of the well pipe member, the outlet fitting having a wall portion surrounding a flow bore that enables fluid to be discharged;

f) a shroud connected to the second end portion of the well pipe; and g) an axial flow inducer screw-type pump impeller at least partially seated in the shroud and operatively connected to the second end of the flexible shaft, the impeller being rotatable during pumping for effecting a transmittal of fluid from the second end portion of the well pipe member to the first end portion of the well pipe member and exciting the outlet fitting flow bore.

2. The pump apparatus of claim 1 wherein the well pipe member encases at least fifty percent of the length of the shaft.

3. The pump apparatus of claim 2 further comprising a flexible sleeve encasing at least fifty percent of the length of the shaft, wherein the well pipe member encases at least fifty percent of the lengths of the shaft and sleeve.

4. The well pump apparatus of claim 1 wherein the impeller and shaft are each supported with water lubricated bearings.

5. The well pump apparatus of claim 1 wherein the drive portion includes a motor drive for rotating the shaft and a water seal in between the motor drive and shaft.

6. The well pump apparatus of claim 1 further comprising a shroud at the lower end portion of the well pipe that completely surrounds the impeller.

7. The well pump apparatus of claim 1 wherein the impeller has a diameter and a length along a longitudinal axis that tracks the center of rotation of the impeller and the diameter is greater than the length.

8. The well pump apparatus of claim 7 wherein the diameter is about four to five inches (4"–5").

9. The well pump apparatus of claim 7 wherein the length is about two to three inches (2"–3").

10. A well pump apparatus for removable placement on a well casing that extends into the earth's surface and including a well bore containing fluid to be pumped, the well casing having an upper end portion defining a wellhead, comprising:

a) an outlet fitting to be positioned at the wellhead, the outlet fitting having a wall portion surrounding a flow bore that enables fluid to be discharged out of the well;

b) a well pipe member that, where the outlet fitting is positioned at the wellhead, the well pipe member extends from the wellhead downwardly to the fluid to be pumped, the well pipe member having an upper end portion, a lower end portion, and a flow bore for conveying fluid that is being pumped from the lower end portion to the upper end portion;

c) a shroud connected to the lower end of the well pipe member;

d) an axial flow inducer screw-type pump impeller positioned in the shroud at the lower end of the well pipe member, the impeller comprising a generally cylindrically shaped impeller boss;

e) the impeller being rotatable during pumping for effecting a transmittal of fluid from the lower end portion of the well pipe member to the upper end portion of the well pipe and the outlet fitting flow bore;

f) a flexible drive shaft for rotating the impeller, the flexible shaft extending in between the impeller and the outlet fitting and including a drive portion that extends through the wall of the outlet fitting at the wellhead, the flexible shaft and well pipe member forming an assembly that is capable of being coiled into a circle with a minimum diameter between about one to ten feet (1'–10');

g) a wetted bearing forming a rotary support in between the impeller and well pipe; and h) a drive supported by the outlet fitting for rotating the flexible drive shaft.

11. The well pump apparatus of claim 10 wherein the flexible drive shaft is supported at its lower end portion with at least one journal bearing and at least one thrust bearing.

12. A well pump apparatus for removable placement on a well casing that extends into the earth's surface and including a well bore containing fluid to be pumped, the well casing having an upper end portion defining a wellhead, comprising:

a) an outlet fitting to be positioned at the wellhead, the outlet fitting having a wall portion surrounding a flow bore that enables fluid to be discharged out of the well;

b) a well pipe member that, when the outlet fitting is positioned at the wellhead, the well pipe member extends from the wellhead downwardly to the fluid to be pumped, the well pipe member having an upper end portion, a lower end portion, and a flow bore for conveying fluid that is being pumped from the lower end portion at the shroud to the upper end portion;

c) a pump impeller positioned inside the shroud at the lower end of the well pipe, said impeller comprising a screw-type impeller;

d) the impeller being rotatable during pumping for effecting a transmittal of fluid from the lower end portion of the well pipe member to the upper end portion of the well pipe and the outlet fitting flow bore;

e) a flexible drive shaft for rotating the impeller, the flexible shaft extending in between the impeller and the outlet fitting and including a drive portion that extends through the wall of the outlet fitting at the wellhead, the flexible drive shaft capable of being coiled into a circle with a minimum diameter between about one to ten feet (1'–10');

f) a wetted bearing forming a rotary support in between the impeller and well pipe;

g) a drive supported by the outlet fitting for rotating the flexible drive shaft; and h) wherein the drive includes a motor drive shaft that is coupled to the flexible drive shaft.

13. A well pump apparatus for removable placement on a well casing that extends into the earth's surface and including a well bore containing fluid to be pumped, the well casing having an upper end portion defining a wellhead, comprising:

a) an outlet fitting to be positioned at the wellhead and removably connectable thereto at the well casing, the outlet fitting having a curved wall portion surrounding a curved flow bore that enables fluid to be discharged out of the well along a curved path and a drive shaft outlet portion with an outlet fitting drive shaft bore that is positioned to receive a motor drive shaft;

b) a well pipe member that, when the outlet fitting is positioned at the wellhead, the well pipe member extends from the wellhead downwardly along a generally vertical path to a level where there is fluid to be pumped, the well pipe member having an upper end portion, a lower end portion that includes a shroud, and a vertical flow bore for conveying fluid that is being pumped from the shroud to the upper end portion;

c) an axial flow inducer screw-type impeller positioned inside the shroud at the lower end of the well pipe member, the impeller being rotatable during pumping to enable fluid to be transmitted from the lower end portion of the well pipe member to the upper end portion of the well pipe and to the outlet fitting curved flow bore;

d) a drive unit that includes a motor drive, a motor drive shaft, and a flexible drive shaft for rotating the impeller, the flexible shaft extending in between the impeller and the outlet fitting and including a drive shaft connecting portion that extends through the wall of the outlet fitting at the outlet fitting drive shaft bore, the flexible shaft being capable of being coiled into a circle with a minimum diameter between about one to ten feet (1'–10');

e) a bearing forming a rotary support in between the impeller and well pipe at the impeller; and f) wherein the well pipe member, drive shaft and impeller can be lifted vertically from the casing as a unit.

* * * * *